United States Patent [19]

Varga

[11] 4,079,580

[45] Mar. 21, 1978

[54] FAIL-SAFE LOCKING DEVICE FOR REEL CARRYING SYSTEMS

[75] Inventor: Joseph A. Varga, Toronto, Canada

[73] Assignee: Ceeco Machinery Manufacturing Limited, Concord, Canada

[21] Appl. No.: 774,587

[22] Filed: Mar. 7, 1977

[51] Int. Cl.[2] ..... D07B 7/06; D07B 3/02

[52] U.S. Cl. ..... 57/127.5; 57/65; 242/129.6

[58] Field of Search ..... 57/58.32, 65, 66.5, 57/127.5, 127.7, 54; 242/129.5–130

[56] References Cited

U.S. PATENT DOCUMENTS

| | | | |
|---|---|---|---|
| 2,499,246 | 2/1950 | Harmon | 57/58.32 |
| 2,773,344 | 12/1956 | Van Hook | 57/127.7 X |
| 2,787,884 | 4/1957 | Bruestle | 57/65 |
| 2,860,479 | 11/1958 | Wheater | 57/65 |
| 2,958,178 | 11/1960 | Crosby et al. | 57/127.5 |
| 2,958,994 | 11/1960 | Reichelt et al. | 57/54 |
| 2,987,870 | 6/1961 | McCleery et al. | 57/66.5 |
| 3,026,062 | 3/1962 | Blaisdell | 242/129.6 |
| 3,147,702 | 9/1964 | Martin | 242/129.51 X |

*Primary Examiner*—John Petrakes

*Attorney, Agent, or Firm*—Lackenbach, Lilling & Siegel

[57] ABSTRACT

A fail-safe locking device for reel support systems is described which is suitable for use with reels such as those used with wire stranders and similar machines. In the embodiments described, a pintle supporting shaft member is normally biased by a spring to an extended position. A safety plunger is provided which has a stepped exterior surface so as to define a recess or step. The safety plunger is normally biased by a spring to a disabling position to urge a blocking member, such as a hardened steel ball or sphere, into the path of movement of an abutment surface of the shaft member to automatically and positively lock the shaft member and the pintle. In the locked condition, the plunger member and, therefore, the pintle, cannot accidentally release the reel. The shaft member and the safety plunger are provided with bearing surfaces against which a fluid medium under pressure may be applied by an operator of the machine to, firstly, move the safety plunger from the disabling to an enabling position to permit the ball or sphere to drop into the recess or notch and, therefore, out of the path of movement of the shaft member abutment surface. Once freed, the plunger member is urged by the fluid medium under pressure to a retracted or releasing position. Two opposing pintle assemblies may be mounted on a cradle typically used in wire stranders, and pneumatic pressure is used by the operator to release the fail-safe locking system to accept or release a reel from the cradle. Electrical means may be used for monitoring the position of the safety plunger and for disabling the machine or issuing an alarm upon movement of the safety plunger to its enabling position and, thereby, permitting the plunger member and pintle to move to a retracted position. The fail-safe locking device is also shown on other reel-supporting systems such as bobbin supporting shafts.

32 Claims, 15 Drawing Figures

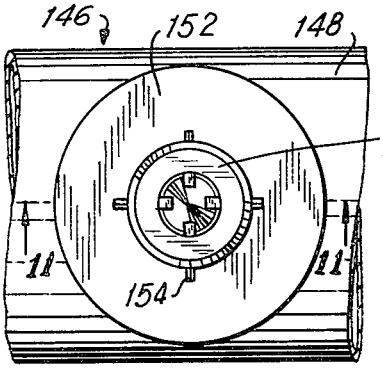
FIG.10
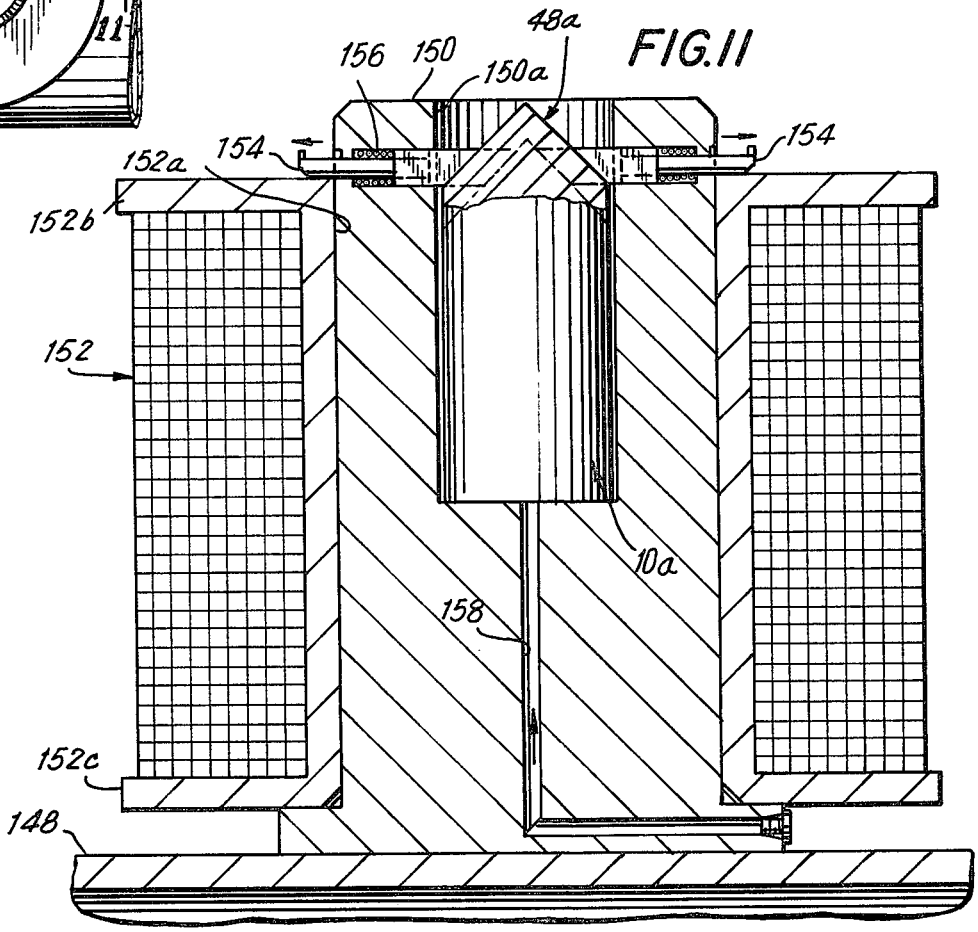
FIG.11
FIG.12
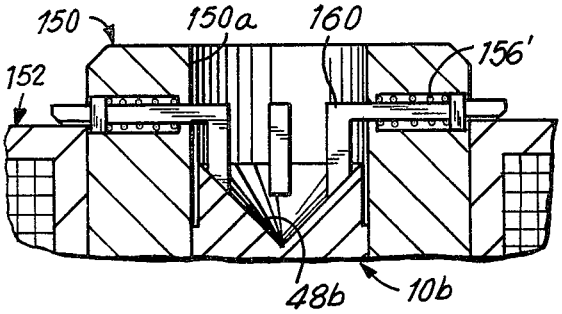
FIG.14
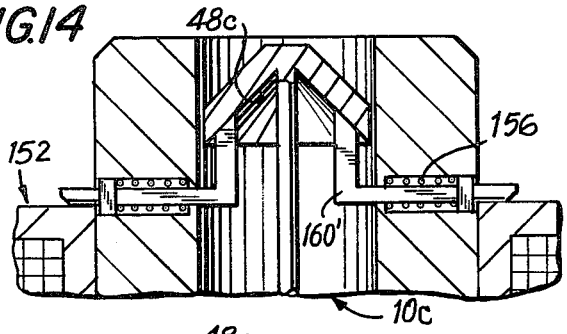
FIG.13
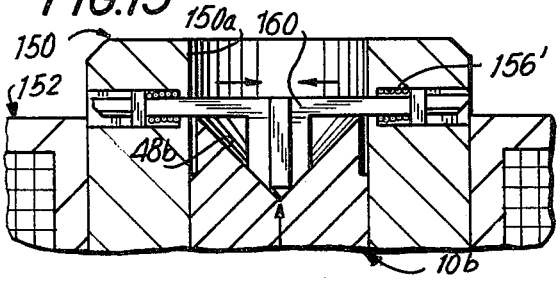
FIG.15
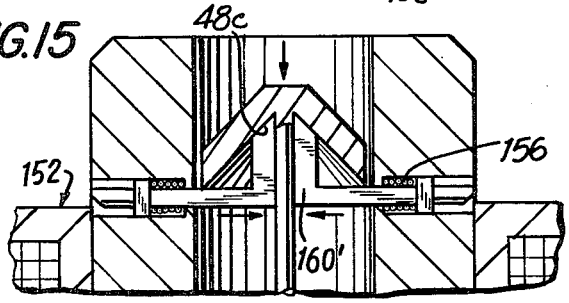

FAIL-SAFE LOCKING DEVICE FOR REEL CARRYING SYSTEMS

BACKGROUND OF THE INVENTION

The present invention generally relates to locking mechanisms, and more particularly to a fail-safe locking device for reel carrying systems.

Frequently, machines of various types receive or operate on a workpiece. In such machines, it is normally imperative that the workpiece be securely maintained in a desired position, both for purposes for safety as well as efficient operation. One particular case in point involves wire stranders which manufacture stranded cable from a plurality of wires. In one type of wire stander, knwon as a tubular strander, the bobbins are placed in cradles which are mounted on bearings in a tubular rotatable frame or housing. During operation, the frame rotates while the cradle, and the bobbins or reels are stationary. The wires are paid-out or pulled from the bobbins and are brought along the frame through guides until they are wound on the core wire which is usually taken from a bobbin mounted outside the frame and passed through the frame along a path that is parallel to the axis of the machine, but displaced from the center as are the other wires paid-out from the bobbins loaded on the cradles inside the tubular frame. Such tubular stranders, as well as rigid stranders and planetary stranders are shown and described in the product catalog issued by Ceeco Machine Manufacturing Ltd. of Ontario, Canada.

Since stranders are usually operating at high speeds, and in view of the large rotating masses, a large amount of kinetic energy comes into play. The safety hazards involved in operating such machines are considerable. For this reason, safety devices have been developed which normally do not allow the operator to start the machines if any malfunction exists. However, due to failures in the safety systems, as well as due to the pressures of production, there have been numerous instances of accidents which have caused considerable injury to personnel and damage to property.

A major problem with prior art safety devices is that they normally require an operator to perform a number of steps which are time-consuming and, therefore, such systems are inconvenient and reduce production. As a result of this, cases are known where operators have intentionally failed to take the necessary or precautionary steps which ensure the safety of operation of the machine. Accordingly, operators cannot always be depended upon to carry out the loading operation as prescribed for a safe running of the machine, especially when such safety procedures reduce the output of the machines, and, therefore, may limit the incentive compensation of the operator. Instances are even known where electrical and mechanical safety systems have been overridden or intentionally bypassed by operators when such systems prevented the operation of a seemingly sound machine.

The safety problem is particularly severe in the case of a tubular strander since the speeds and the energies involved are very high. With respect to such tubular stranders, for example, there are basically three possibilities or types of accidents which can take place. In the first case, the bobbins or reels are not locked properly into position and are released during operation. This jams the reels between the rotatable frame and the cradle causing the cradle to rotate. The reels are eventually thrown out of the tubular frame through the opening thereof. Depending upon the direction of exit, the damage can vary. If the reel is ejected upwardly, it can penetrate through the roof of the building causing injury to persons or damage to property. On the other hand, it can be ejected sideways, thus increasing the changes or injuries to personnel as well as damage to adjacent machines that can, in turn, trigger further accidents. If the bobbin is ejected downwardly, it usually jams the tubular frame against the floor and shatters the tube. Accidents of this type are frequent and heavy damage to property and people have been recorded.

A second type of accident involving tubular stranders can be triggered by a bearing failure which causes the cradle to rotate together with the frame. The consequences of such failure are usually the same since cradles and locking mechanisms are currently designed for stationary conditions and cannot withstand the forces generated when the cradle and the bobbin are rotating at approximately the same speed as that of the tubular frame. The consequence of this situation is a release of the reel and a type of accident similar to that described above. The third type of accident which is possible is that wire gets tangled up around the cradle causing the cradle to rotate and resulting in an accident as above described.

Accidents caused by accidental release of reels have also been recorded in the operation of rigid stranders and planetary stranders, but due to the lower operational speeds, such occurrences are less frequent. Furthermore, the open construction of these machines gives the operator a better opportunity to see if a dangerous situation is developing.

Similar problems such as those discussed in connection with above stranders can take place in other types of machinery, particularly where rotatable parts or devices are intended to be temporarily and securely retained on a machine. For example, on those rigid stranders where reels are mounted on cantilevered shafts, operator dependent locking devices are presently used for securing the reels on the shafts. Accidents have been recorded where reel have separated from the shafts on which they are mounted as a result of operator failure to properly secure the manual locking devices. Frequently, when the parts are held, such as by pintles, the positional instability of the pintles is at least partly caused by the high speeds of rotation and the centrifugal forces which are generated thereby. Accordingly, such pintles must not deviate from their retaining positions irrespective of operator negligence and substantially independently of mechanical or electrical failure. Although ball locking devices have been used before, for example, on rewinding machines manufactured by Ceeco machinery Manufacturing, Ltd., and pneumatic operated spring pintle assemblies are used on tubular stranders manufactured, for example, by the Stolberger Maschinenfabrik & Co. KG of Aachen, West Germany, there is not presently known a fail-safe device for reel carrying systems.

SUMMARY OF THE INVENTION

Accordingly, it is an object of the present invention to provide a fail-safe locking device for reel carrying systems, which overcomes the above-described disadvantages of presently existing reel carrying systems.

It is another object of the present invention to provide a fail-safe locking device which is simple in construction and economical to manufacture.

It is still another object of the present invention to provide a fail-safe locking device that considerably reduces the safety hazards caused by operator negligence or result from electrical or mechanical malfunction.

It is yet another object of the present invention to provide a fail-safe locking device which is suitable for use with pintle assemblies mounted on cradles or other shaftless reel carrying systems used in wire stranders.

It is another object of the present invention to provide a fail-safe locking device suitable for use with shaft-mounted bobbins or reels, particularly cantilevered shafts on rigid-type stranders.

It is a further object of the present invention to provide a fail-safe locking device which utilizes a primary, spring actuated locking element, and also includes a secondary mechanical lock which automatically blocks the mechanical movement of the primary element to allow the system to withstand large centrifugal forces.

It is still a further object of the present invention to provide a fail-safe locking device which utilizes hydaulic pressure, such as pneumatic means, for moving a secondary mechanical locking mechanism to a position which permits a primary locking mechanism on which a reel engaging assembly is mounted to move from a retaining position to a releasing position.

It is yet a further object of the present invention to provide a pneumatic actuated fail-safe locking device for reel engaging assemblies wherein primary and secondary locking devices can only move to releasing positions upon application of pneumatic pressure, and the primary and secondary locking devices are spring actuated to automatically return to their locking or retaining positions as soon as the pneumatic pressure is removed.

It is an additional object of the present invention to provide a fail-safe locking device which requires positive action by an operator to release a reel or bobbin retained by a reel engaging assembly, but which automatically and without any positive steps taken by the operator reverts and positively locks the reel engaging assembly in its retaining position.

It is an additional object of the present invention for providing a primary locking reel engaging mechanism, and a secondary mechanical lock for preventing any movements of the primary reel locking mechanism prior to application of a pneumatic pressure to the secondary mechanical lock, and further including electrical monitoring means for monitoring the position of the secondary mechanical lock to disable the associated machine upon movement of the secondary mechanical lock from its locking or disabling position to its releasing or enabling position.

It is yet an additional object of the present invention to provide a fail-safe locking device which includes a primary locking element or member on which the reel engaging mechanism is mounted, a secondary mechanical lock which normally locks the position of the primary locking element and prevents movement thereof, and which includes means to apply a pneumatic pressure to the primary locking element and the secondary mechanical lock to release the secondary mechanical lock and move the primary locking element to its retracted or releasing position.

In order to achieve the above objects, as well as others which will become apparent hereafter, the fail-safe locking device for a reel carrying system which is mounted on a support member in accordance with one embodiment of the present invention comprises a first actuatable member mounted for slidable movement relative to the support member along an axis between first and second positions. Engaging means cooperate with said first actuatable member for securely engaging a reel on the reel carrying system in said first position of said first actuatable member and for releasing the reel in said second position of said first actutatable member. First biasing means is provided for urging said first actuatable member to said first position. Locking means is provided which cooperates with said first actuatable member and the support member and is movable between locking and releasing positions for permitting movement of said first actuatable member from said first to said second positions only in the releasing positions thereof. A second actuatable member is provided mounted for slidable movement relative to the support member between the enabling and disabling positions for moving said locking means from said locking to said releasing positions only in the enabling position thereof. Second biasing means is provided for urging said second actuatable member to said disabling position, said first and second actuatable means being provided with bearing surfaces. Hydraulic means is provided which is adapted to apply a fluid medium under pressure to said bearing surfaces for moving said actuatable member to said enabling position only upon application of said fluid medium under pressure to thereby permit movement of said locking means to said releasing position, and for subsequent movement of said first actuatable member and said pintle to said pintle to said retracted position.

In one presently preferred embodiment, the first actuatable member is a spring activated mechanism or element which is coupled with a secondary mechanical locking system which comprises the second actuatable member, the secondary mechanical locking system automatically and positively locking the spring activated mechanism until an operator applies hydraulic or pneumatic pressure to the coupled members. The primary locking action by said engaging means is advantageously caused by a spring, but once the secondary mechanical locking system has operated, it mechanically locks the movement of said engaging means, thus allowing the system to withstand the large centrifugal forces generated during an accident.

The system is not operated manually, but can be opened only by using hydraulic means, such as air pressure which could be applied, for example, through a coupling on a reel-supporting cradle which supports the fail-safe locking system. The operator uses an air pressure flexible hose which is provided on the stationary supports of the tubular rotating frame. To open the locking device, the operator places the nozzle of the air pressure hose on a coupling positioned on the cradle. The air pressure causes the secondary lock to release and then forces the primary locking to move against the springs freeing the empty reel for unloading. Once the new loaded reel is positioned in the cradle, the operator disconnects the air hose, the spring-loaded mechanism locks the reel and automatically moves the secondary lock to a position which positively locks the primary locking element and the engaging means supported thereon.

Therefore, the locking devices operates irrespective of operator action. If by chance the operator forgets to remove the air pressure hose, an electrical interlock on the secondary locking device may be provided which prevents the machine from rotating. However, if by a system failure the machine rotates during its first revolution, it will sever the pressure hose, thus eliminating air pressure from the self-locking device. Under this condition, the mechanism will self-lock and avoid accidental release of the reel.

Accordingly, the apparatus in accordance with the present invention provides a fail-safe locking device which automatically reverts to its locking mode independently of operator negligence or inaction, and prevents an operator from bypassing the system by positive action or inaction.

BRIEF DESCRIPTION OF THE DRAWINGS

Further advantages of the invention will become apparent from a reading of the following specification describing illustrative embodiments of the invention. The specification is to be taken with the accompanying drawings, in which:

FIG. 10 is a fragmented top plan view of a rigid-type strander showing how the locking device of the present invention can be used in shaft mounted reel-carrying systems;

FIG. 11 is an enlarged cross-sectional view of the strander and bobbin or reel shown in FIG. 10, taken along line 11—11 to show the details of the reel engaging means in the form of moving fingers in place of the pintles shown in the earlier embodiments;

FIGS. 12 annd 13 are similar views to FIG. 11, but showing another embodiment of the reel-engaging means in the reel locking and releasing portions respectively; and FIGS. 14 and 15 are similar views to FIGS. 12 and 13 respectively but showing still another embodiment of the reel-engaging means.

DESCRIPTION OF THE PREFERRED EMBODIMENTS

The present invention will be primarily described, by way of illustration only, with respect to pintle assemblies on tubular-type stranders. However, as will become evident to those skilled in the art, and as will be briefly described in connection with FIGS. 10 to 15, the locking device of the present invention can also be used with other reel-engaging means on other reel carrying systems.

Figure 1:
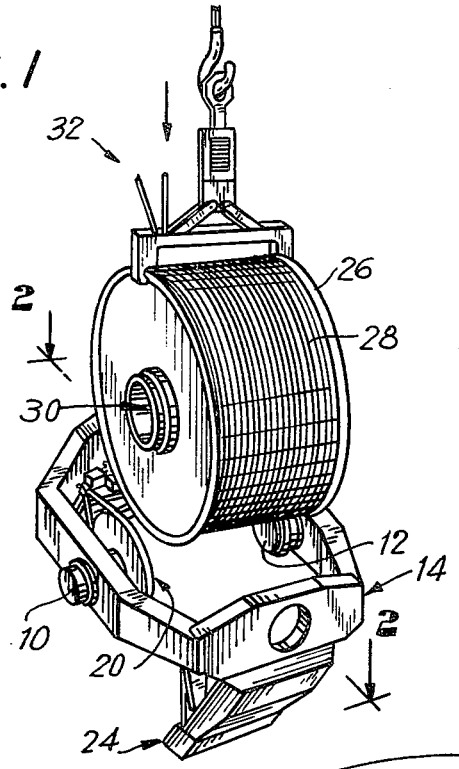
FIG. 1 is a perspective view of a cradle of the type receivable within a tubular strander, showing a pintle assembly according to the present invention mounted on the cradle, and showing a reel being lowered into the cradle while the pintles are in retracted positions.
Figure 3:
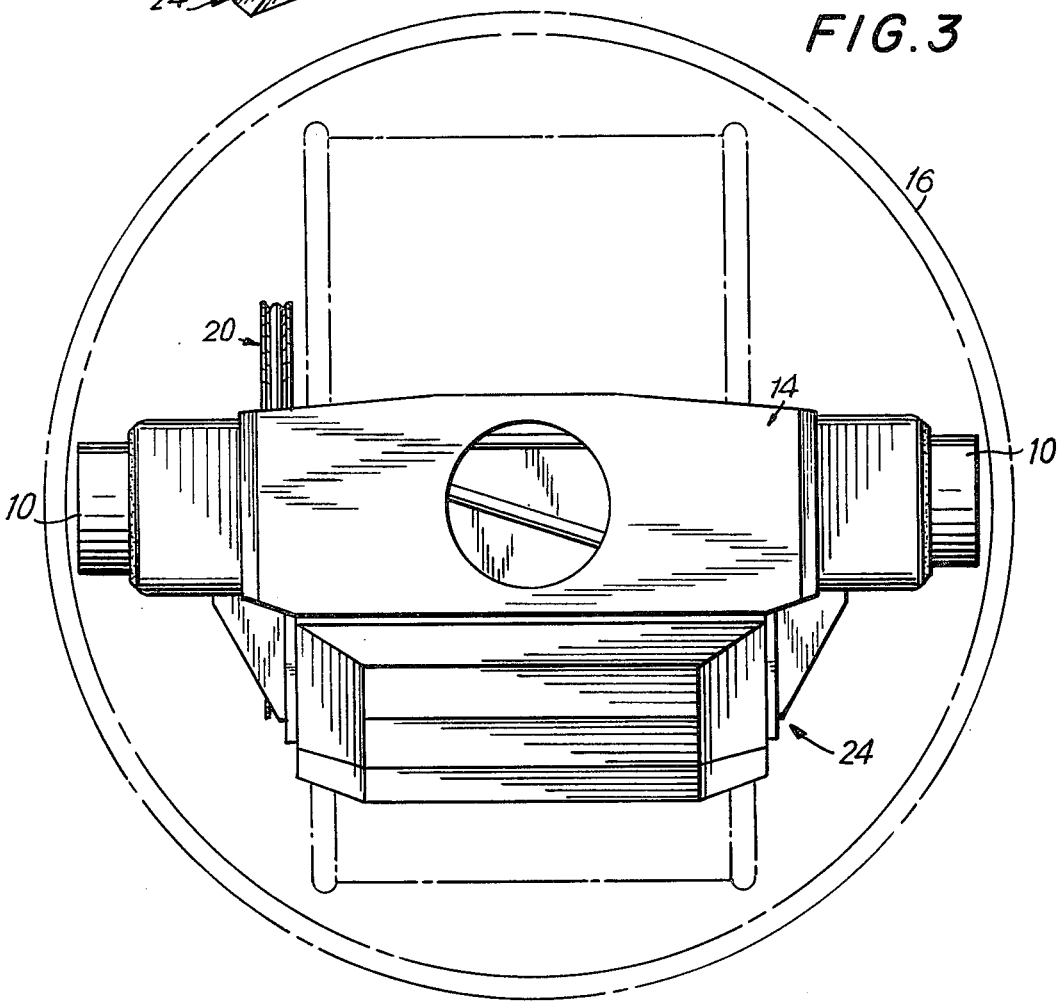
FIG. 3 is a side elevational view of the cradle shown in FIG. 2, as viewed along line 3—3.
Figure 2:
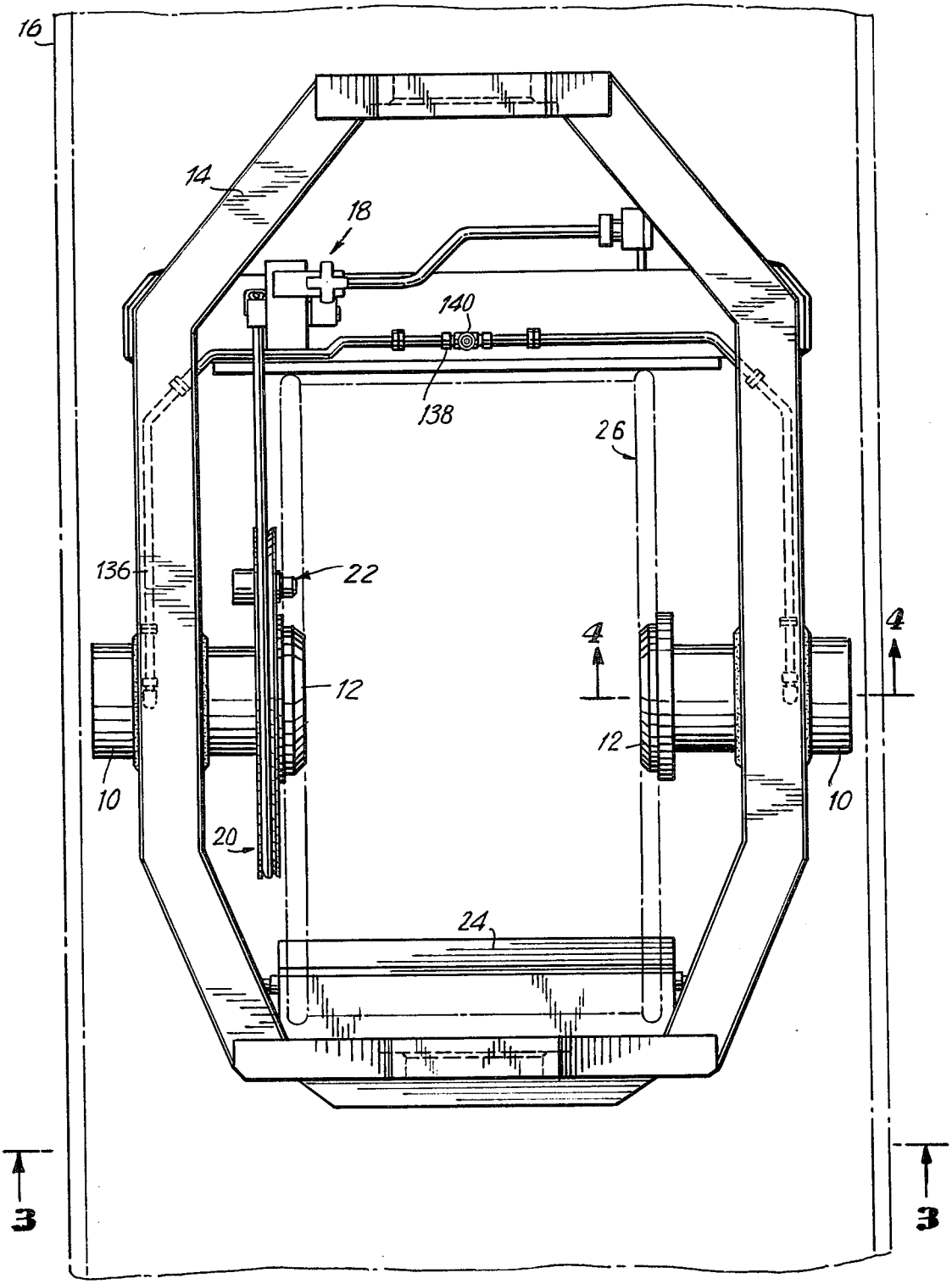
FIG. 2 is an enlarged top plan view of the cradle shown in FIG. 1, as viewed along line 2—2 in FIG. 1, and showing in dashed outline the manner in which the cradle is positioned within the tube of a tubular strander, and the manner in which the reel is supported within the cradle.

Referring now specifically to the drawings, in which the identical or similar parts have been designated by the same reference numerals throughout, and first referring to FIGS. 1–3, the locking device of the present invention is generally designated by the reference numeral 10. As will become evident from the description that follows, and as noted above, while the fail-safe locking system of the present invention is described as being incorporated in pintle assemblies mounted on cradles and the like as used on wire stranding machines, the same or similar fail-safe locking systems can be used in many other types of applications where a movable or retaining member is intended to normally be positioned in an extended or retracted position and only moved to a retracted or extended position respectively when the associated machine is not in operation.

As can best be seen in FIGS. 2 and 3, two pintle assemblies 10 are provided, although it should be clear that in certain instances only a single locking device or pintle assembly 10 in accordance with the present invention may be sufficient, in which case the other pintle is fixedly mounted on the frame. The pintle assemblies 10 are shown to be provided at the free ends facing inwardly or facing each other with pintles 12. The pintle assemblies 10 are mounted on a cradle frame 14. The cradle 14 is typically of the type used in high speed tubular stranders manufactured by Ceeco Machinery Manufacturing Ltd. The tube 16 of such tubular stranders are shown in dashed outline in FIGS. 2 and 3. Such cradles 14 are typically provided with a quick rekease brake mechanism 18 which cooperates with a brake ring 20 in a known or conventional manner. A drive dog 22, also of a conventional type, is provided on the brake ring 20. A conventional reel stop 24 is shown which is adapted to cooperate with the reel 26 when the same is received within the cradle 14 and supported by the pintles 12. In FIG. 1, the reel 26 is shown to be filled with wire 28 which is to be stranded, which reel includes a bore 30 dimensioned to receive the pintles 12 therein. The reel 26 is shown being lowered by a hoist 32 into position within the cradle 14. As will be described hereafter, the pintles 12 are, during such an operation, in the retracted positions thereof to permit the reel 26 to be lowered into the cradle 14, after which the pintles 12 are moved to their extended positions, as suggested in FIGS. 2 and 3 in which condition the reel 26 is securely retained. The pintle assemblies 10 of the precent invention assure that the pintles 12 remain in their extended positions during the operation of the machine to retain the reels 26 securely and prevent the same from inadvertently or accidentally be ejected from the cradle 14.

Figure 4:
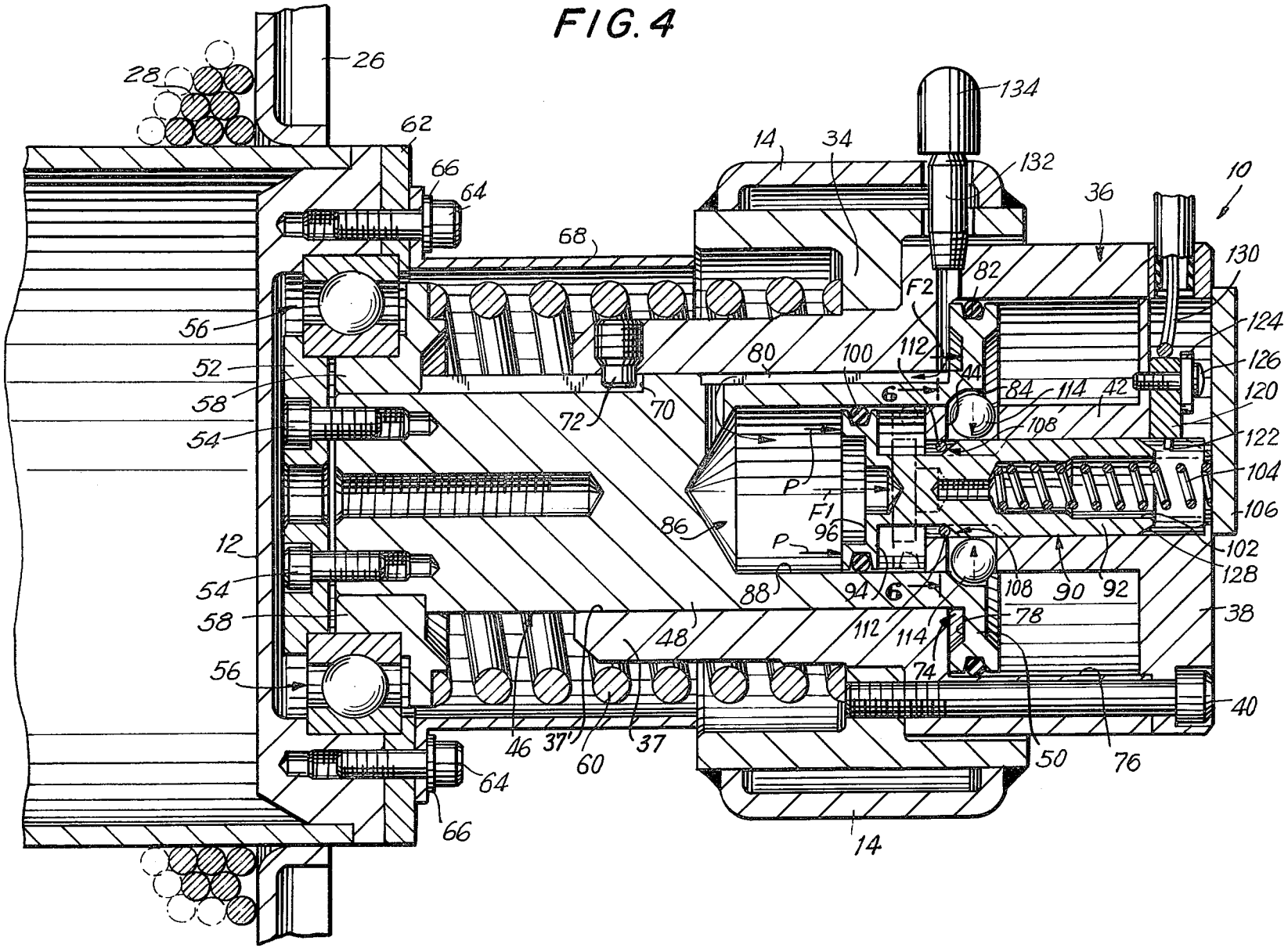
FIG. 4 is an enlarged cross-sectional view of one of the pintle assemblies taken along lines 4—4 in FIG. 2.

Referring to FIG. 4, there is shown the details of the pintle assembly 10 in accordance with one presently preferred embodiment of the present invention which forms the fail-safe locking system which assures that the pintles 12 are locked in the extended positions thereof, this taking place automatically without the need for the operator to take precautionary steps as has heretofore been required. Additionally, the pintle assembly 10 of the present invention permits and causes retraction of the pintles 12 only upon application of a hydraulic fluid under pressure, such as pneumatic pressure, as will be described hereafter.

Figure 5:
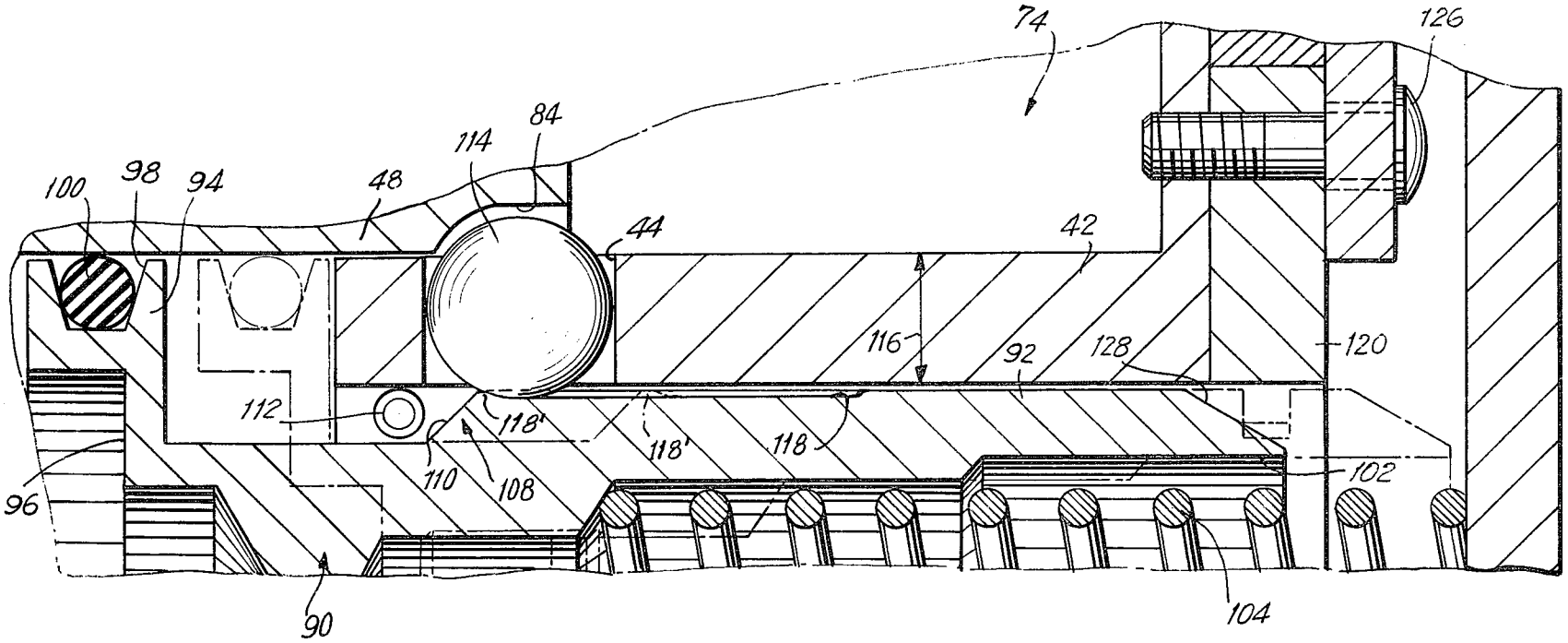
FIG. 5 is an enlarged view of the pintle assembly shown in FIG. 4, showing the details of the locking mechanism.

The cradle 14 includes a frame which may, for example, include an inwardly directed annular flange 34 to which a cylinder 36 and an end plate 38 are securely attached by means of bolts 40. The end plate 38 includes an inwardly directed cylindrical wall portion 42 which defines an axial bore or cylindrical cavity and which is provided with one or more through openings 44, as is best shown in FIG. 5 and will be more fully described hereafter.

As can best be seen from FIG. 4, the cylinder 36 includes a stepped-down cylndrical wall 37 which defines a cylindrical cavity or bore 37' which receives a portion of a first actuatable member or primary locking element 46 which is mounted for slidable movement within the cylinder 36 relative to the support member or cradle 14 along an axis. The primary locking element 46 is in the nature of a shaft member and includes a shaft portion 48 dimensioned to correspond with the interior bore or cavity defined by the cylinder 36. The primary locking element 46 is provided at one end thereof with a piston portion 50 which will be more fully described hereafter.

The primary locking element 46 is provided at the end opposite to where the piston portion 50 is provided with a front plate 52 which is secured to the shaft portion 48 by means of bolts 54. The front plate 52 secures ball bearings 56 against a spring support plate 58 which in turn is urged in the direction of the spring support plate by means of a helical compression spring 60 which acts between the cradle frame 14 and the spring support plate 58.

Mounted on the ball bearings 56 is the pintle 12 which is clamped to the ball bearings by means of a back-up ring 62 which is connected to the pintle 12 by means of bolts 64 and spring lock washers 66 as shown. In order to protect the spring 60 and keep the interior of the pintle assembly 10 free of contaminants, there is advantageously provided a spring cover 68 which is connected to the back-up ring 62 and which shares the common axial movement of the pintle 12 together with the movements of the primary locking element 46.

With this arrangement, the primary locking element 46, together with the pintle 12, are urged outwardly to the extended position thereof as shown in FIG. 4 to cause at least a portion of the pintle 12 to be received within the bore 30 of the reel 26.

To limit excessive movements of the primary locking element, the set screw 72 is positioned within a groove 70 to prevent rotation of the primary locking element 46 when the pintle 12 and the reel 26 rotate. Locking of the primary locking element against rotation prevents wear, for example, of the O-ring 82 and prolongs the life of the locking device 10. The primary locking element 46 is limited in its movement beyond its extended position by virtue of its piston portion 50 coming into engagement with an annular shoulder of the cylinder 36 as shown in FIG. 4.

The cylinder 36 as well as the end plate 38 are configurated and cooperate together to form a bore or cavity 74 which generally contains the piston portion 50, and which is defined by a cylindrical surface 76 which corresponds to the peripheral configuration of a bearing surface 78 formed on the piston portion 50.

As will be more fully described hereafter, there is provided a conduit 80 which is in communication with the bore or cavity 74 for selectively applying a fluid medium under pressure against the bearing surface 78. To ensure efficient operation, there is advantageously provided a seal about the periphery of the piston portion 50, shown in FIG. 4 as being an O-ring 82.

The primary locking element is provided with an abutment surface 84, shown in the embodiment of FIG. 4 as being generally in the region of the piston portion 50. The abutment surface 84 is an important feature of the present invention and will be more fully described below. The primary locking element 46 is also provided with a bore or cavity 86 which is defined by a cylindrical surface 88, which bore or cavity 86 is also in fluid flow communication with the conduit 80. In this manner, application of a fluid medium under pressure into the conduit 80 simultaneously applies the fluid under pressure to both cavities 74 and 86.

Coaxially arranged with the primary locking element 46 is a second actuatable member in the nature of a secondary mechanical locking system or safety plunger 90 which has a shaft portion 92 provided with a piston portion 94 at one end thereof which is similar in configuration and functions as the piston portion 50 of the primary locking element 46. The piston portion 94 has a bearing surface 96 which faces the interior of the bore or cavity 86, and has a periphery which generally corresponds to the shape of the cylindrical surface 88. In order to prevent escape of the fluid under pressure and generally improve the operation of the device, there is advantageously provided a seal extending about the periphery of the piston plunger 94, such as in an annular groove 98 (shown in FIG. 5), which may be in the nature of an O-ring 100.

The end of the shaft portion 92 opposite to where the piston portion 94 is provided is formed with an axial bore 102 as shown which receives a helical compression spring 104 which acts between the safety plunger 90 and an end plate 106 fixedly mounted relative to the cradle frame 14 to thereby urge the safety plunger or secondary mechanical locking plunger 90 in the direction of the primary locking element 46 to move the piston portion 94 inwardly of the bore or cavity 86.

Referring particularly to FIG. 5, the safety plunger or locking element 90 is formed with a step or notch 108 in its exterior surface to define a generally bevel or inclined surface 110 as shown. An important feature of the present invention is that when the safety plunger 90 is in its disabling position shown in FIGS. 4 and 5, the greater dimension of the shaft portion 92 is substantially in opposition to the through opening 44 in the wall portion 42. Therefore, the function of the spring 104 is to urge the safety plunger 90 to move to the disabling position and bring the greater diameter or dimension on the shaft portion of the safety plunger substantially in opposition to or in registry with the through opening 44, for reasons which will be described below.

Figure 6:
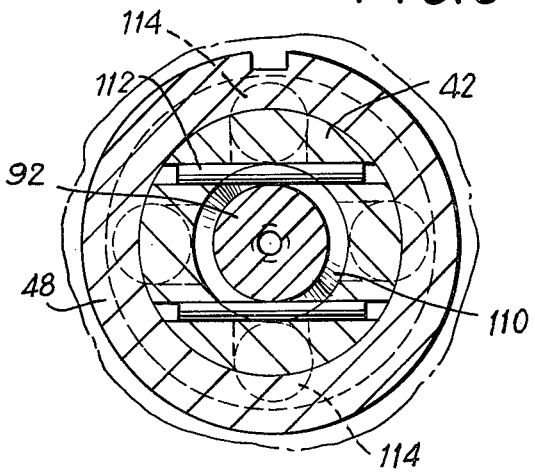
FIG. 6 is a sectional view of the pintle assembly taken along line 6—6 in FIG. 4.

To prevent excessive axial movement of the safety plunger 90 beyond its disabling position shown in FIGS. 4 and 5 as a result of the action of the spring 104, suitable stop means may be provided. As best shown in FIG. 6, one form of stop means which may be used for this purpose may consist of one or two pins 112 which are spaced from the axis and directed substantially normally thereto. Such pins 112 are mounted on the wall portion 42 at a radial distance to substantially correspond to the radial distance of the bevel or inclined surface 110 from the axis, so that the pins 112 abut against the bevel or inclined surface 110 to thereby limit in this manner excessive axial movement of the safety plunger 90. However, any other type of stop means may be used in place of the pins 112.

Referring to FIGS. 4 and 5, an important feature of the present invention is the provision of a blocking member in the nature of a hardened steel ball or sphere 114 which is captured within the through opening 44 and mounted for only radial movements. In FIGS. 4 and 5, the ball 114 is shown to be in a radially outward locking position wherein the ball 114 is at least partially positioned in the path of movement of the abutment surface 84 to block movement of the primary locking element 46 from the extended position as shown in FIG. 4. In this condition, the ball 114 is maintained in the radially outward or blocking position due to the disabling position of the safety plunger 90 which forces the ball 114 to the position shown as the result of the action of the spring 104.

The diameter of the ball 114 is selected to be greater than the thickness 116 of the wall portion 42, so that at least a portion of the ball 114 projects beyond the wall portion 42 to assure that the primary locking element 46 is blocked and prevented from axially moving from its extended position. With this arrangement, it should be clear that the ball 114 is captured within the through opening 44 and prevented from moving axially as the result of the fixed nature of the wall portion 42. However, the ball 114 may move radially inwardly or outwardly, and will so move in response to radial forces applied thereto. However, although the primary locking element 46 may apply radially inward forces to the ball 14, the ball cannot move out of the blocking path or path or movement of the abutment surface 84 so long as the safety plunger 90 is in its disabling position as shown in FIG. 4 and 5.

Referring to FIG. 5, the increased diameter shaft portion 92, which has a substantially cylindrical external surface, is provided with a longitudinal surface groove 118 for each hardened steel ball 114. The grooves 118 terminate short of the step 108 to form ledges or banks 118' which prevent a ball 114 from rolling out of the groove 118 into the step 108, wherein the primary element 46 applies a radially inward force on the ball, such as when centrifugal forces act on the primary element 46.

As is evidence from FIGS. 4 and 5, the primary locking element 46 cannot move because the four balls 114 do not allow it to retract into the cylinder 36 as long as the secondary safety plunger 90 is in the extended locked position. However, if pressure is applied to the pintle, this force will act on the four balls pushing them radially inwardly toward the safety plunger 90. Centrifugal forces will tend to urge the primary locking element 46 to apply such inward forces on the balls 114, as well as tend to move the secondary safety plunger 90 to its retracted, enabling position against the action of the spring 104. The spring 104 can be designed in such a way as to maintain the safety plunger in its disabling position under the effect of high centrifugal forces, but, even if it is such that it could not maintain the safety plunger in its disabling position under high centrifugal forces, the ledges or banks 118' prevent the safety plunge from moving from its normally extended disabling position to its retracted enabling position whenever the primary locking element 46 applies radially inward forces on the safety plunger. This is due to the engagement between the balls 114 and the ledges 118'. Therefore, even under very high pressure, the pintle 12 is mechanically and positively locking in position. Even if the cradle 14 rotates at the speed of the tubular frame, and considerable axial forces are applied to the pintle, it would be impossible to obtain a release up to forces that will destruct the entire assembly. During normal operation, the primary locking element does not apply radially inward forces on the balls 114 and movement of the safety plunger 90 against the action of the spring 104 merely causes the balls 114 to roll over the ledges or banks 118' and subsequently drop into the step 108 as described above. By making the ledges or banks 118' typically a few thousandths of an inch high, these are small enough to permit the balls to roll over them without any difficulty under retracting movements of the safety plunger 90, while actually locking the safety plunger whenever the primary locking element 46 applies radially inward forces on the balls 114. As noted above, even small ledges or banks have been found to be satisfactory to prevent inadvertent unlocking of the pintle assembly 10 even under the highest anticipated centrifugal forces.

While one blocking member may be provided, it is advantageous to provide a plurality of such blocking members which are substantially uniformly spaced from each other about the axis of the pintle assembly 10 and, in the embodiment shown in FIGS. 1–6, there are four balls 114 spaced from each other 90° apart, as best shown in FIG. 6. Each ball 114 is received with an associated through opening 44, and the operation of each of the balls 114 is substantially the same as described above. Also, while a spherical ball bearing is shown in the presently preferred embodiment, it will become evident to one skilled in the art that the blocking members need not be spherical, but may assume any desired configuration, as long as the blocking members at least partially project into the path of movement of the abutment surface 84 when the safety plunger 90 is in its disabling position. Thus, the blocking members may be in the nature of cylinders, pins, plungers and the like. The present invention, therefore, is not limited to the specific constructions described, but to the general principles which have been described which provide automatic and positive locking of the primary locking element 46 by means of the actions of the secondary locking element or safety plunger 90 in cooperation with the movable blocking element or ball 114 which cooperates with an abutment surface of some type on the primary locking element.

The pintle assembly 10 is advantageously also provided with an electrical limit switch 120 which serves as a sensor means for monitoring the position of the safety plunger 90. The limit switch 120 has a plunger 122 which projects into the path of movement of the safety plunger 90, the position of the limit switch 120 being maintained by means of a limit switch clamping plate 124 which is fixedly mounted on the end plate 38 by means of bolts 126. To facilitate actuation of the limit switch 120 and prevent damage thereto, the shaft portion 92 of the safety portion 90 is advantageously provided with a bevel surface 128 which is in the nature of a cam surface which initiates the actuation of the limit switch 120 when the safety plunger 90 moves from the disabling position thereof shown in FIGS. 4 and 5 to an enabling positon to be described. The limit switch 120 is provided with electrical conductors or leads 130 which may be connected to any suitable electrical circuit which may, for example, disconnect the machine on which the pintle assembly 10 is mounted from the power mains or may initiate an alarm upon movement of the safety plunger 90 from its disabling position which thereby enables the movement of the primary locking element 46.

Referring to FIGS. 2 and 4, the conduit 80 is shown to be in fluid flow communication with a nipple 132 which is in turn coupled by means of an elbow 134 to a tubing 136 which extends to an accessible portion of the cradle 14. The tubing 136 is connected by means of a female branch tee 138 to a speed coupler and connector 140. As is evident from FIG. 2, the female branch tee 138 permits steel tubes to emanate from the coupler 140 to both pintle assemblies 10 on opposing sides of the cradle frame 14.

The operation of the pintle assembly 10 will now be described to the extent to which it has not been described above. The spring 60 urges the primary locking element 46 to its extended position shown in FIG. 4, and the safety plunger 90 is urged to its disabling position as a result of the action of the spring 104, causing the ball 114 to ride over the surfaces 110 and ledges 118' and on to that portion of the shaft portion 92 of greater diameter to cause at least a portion of the balls 114 to move into the path of movement of the abutment surfaces 84. This action of the helical compression springs 50 and 104 automatically moves the pintle 12 to its extended or retaining position without reliance upon the operator of the machine. The primary locking element 46 and the safety plunger 90 will remain in these extended and disabling positions respectively until the operator of the machine applies a fluid medium under pressure to the coupler 140.

In order to insert a reel 26 or remove the same from the pintle 14, the operator applies a mating coupler to the connector 140, such as an air pressure hose, and simultaneously applies pressure through the tubings 136 to the conduits 80 of each of the pintle assemblies 10. Application of air under pressure into the conduit 80 of the pintle assembly 10 shown in FIG. 4 causes a pressure P to be developed on each of the bearing surfaces 78 and 96. However, initially the pressure applied to the bearing surface 78 do not move the primary locking element 46 because it is locked by the balls 114 which are in abutment against the surfaces 84 as described above. However, the fluid pressure P is shown to be acting upon the bearing surface 96 in FIG. 4 to develop a force F1 which acts upon the safety plunger 90 and urges the same to move away from its disabling position and move to its enabling position against the action of the spring 104. Movement of the safety plunger 90 to its enabling position shown in FIG. 7 brings the step 108 into registry with the through openings 44 to permit the balls 114 to moe sufficiently radially inwardly so as to move out of the path of movement of the abutment surfaces 84. Thus, movement of the safety plunger 90 in this manner causes the ball bearings to move from their locking to their releasing positions.

Figure 7:
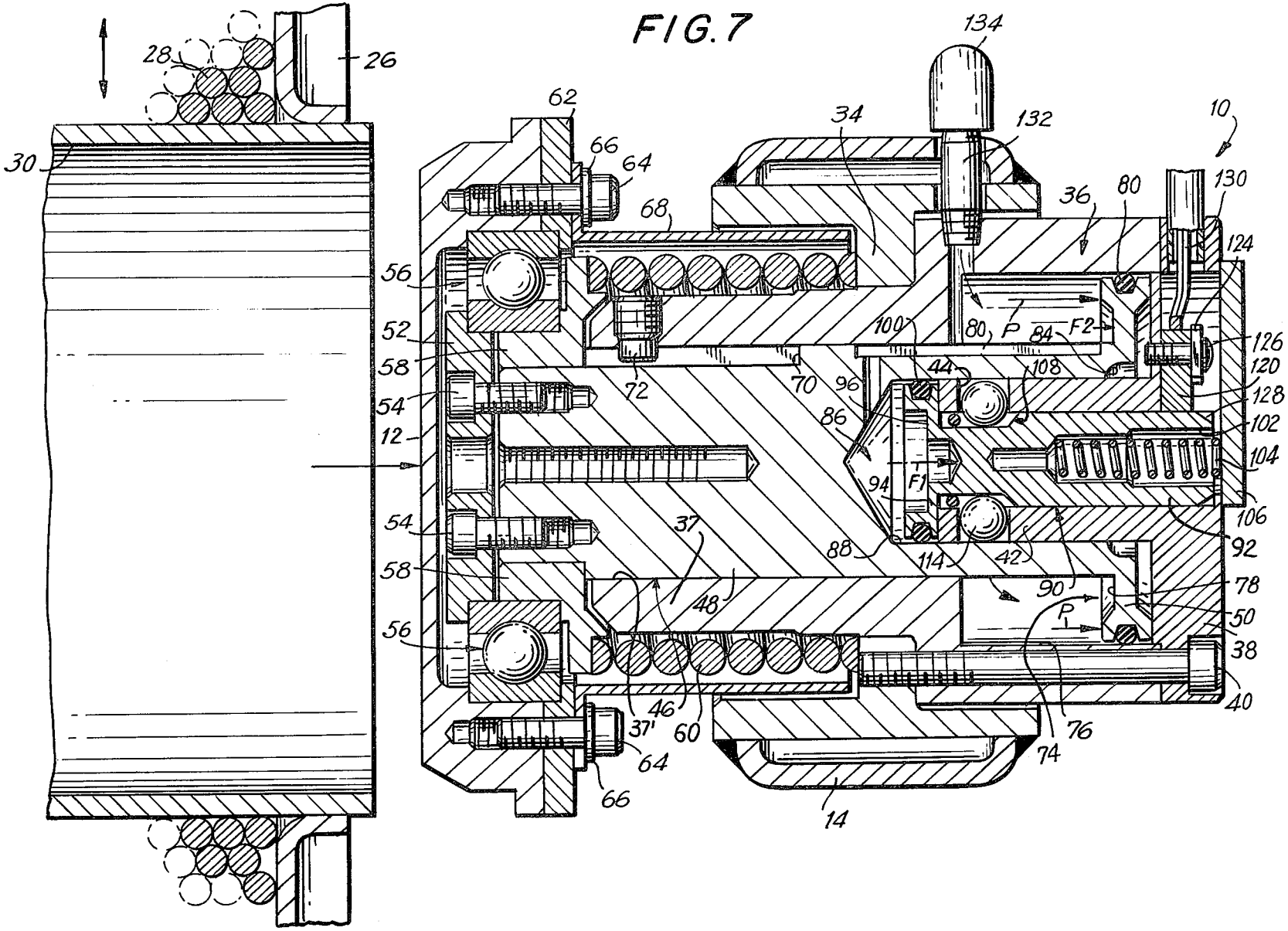
FIG. 7 is similar to FIG. 4, but showing the pintle assembly having moved from an extended position to a retracted position upon application of pneumatic pressure.

Referring to FIG. 7, the fluid under pressure continues to apply pressure P upon the bearing surface 78 to thereby apply a force F2 which causes the now released primary locking element 46 to move from its extended position to its retracted position against the acton of the compression spring 60.

The above-described construction, therefore, automatically provides positive locking of the primary locking element 46 which bears the pintle 12, while the same external fluid under pressure which releases the primary locking element 46 also urges the same to move to its retracted position to thereby facilitate insertion and removal of the reels 46 from the cradle frame 14.

As soon as the pneumatic or hydraulic pressure is applied to the conduit 80, and the safety plunger 90 is moved from its disabling to its enabling position, the limit switch 120 is actuated by virtue of engagement between the plunger 122 and the can surface 128. This can be used, as suggested above, to disable the machine by removing the electrical power therefrom whenever the safety plunger 90 is in any position other than the disabling position shown in FIG. 4, or may be used to actuate an alarm which provides notice to the operator that the pintle 12 is not in its extended or retaining position.

When used in conjunction with cradles 14 on tubular stranding machines, the locking device including the ball 114 and the bearing surfaces 84 comes into play only when needed since during normal operation the spring 60 is sufficient to maintain th pintle 12 in the reel 26. Only when a malfunction occurs is the locking device which includes the abutment surfaces 84 and the balls 114 subjected to stresses. This construction, therefore, increases the life and the reliability of the device because under normal circumstances the abutment or engaging surfaces which make up the locking device are not subjected to any wear at all.

Figure 8:
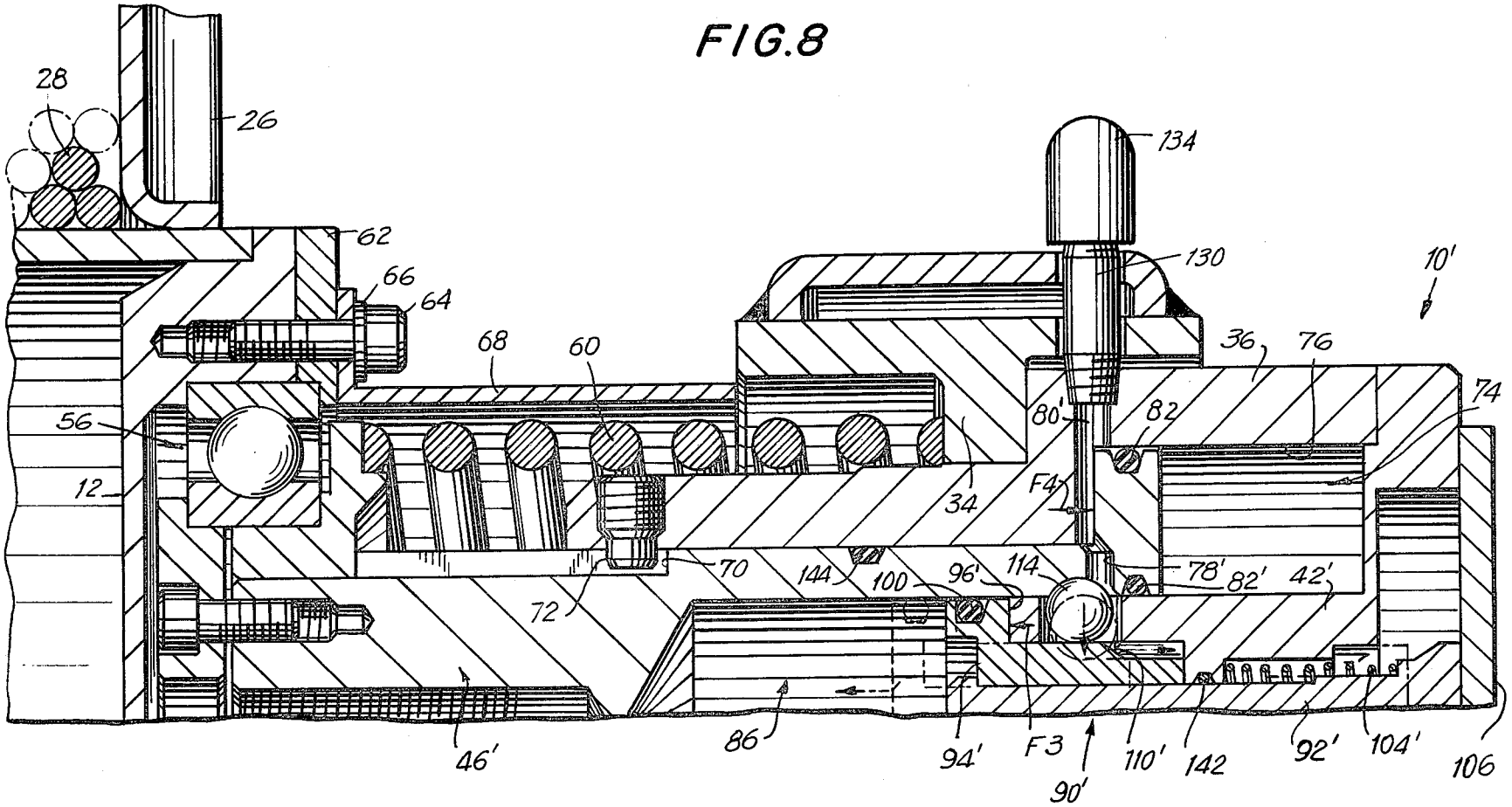
FIG. 8 is a longitudinal cross-sectional view of the upper half only of a pintle assembly in accordance with another embodiment of the present invention, showing the same in an extended or retaining position
Figure 9:
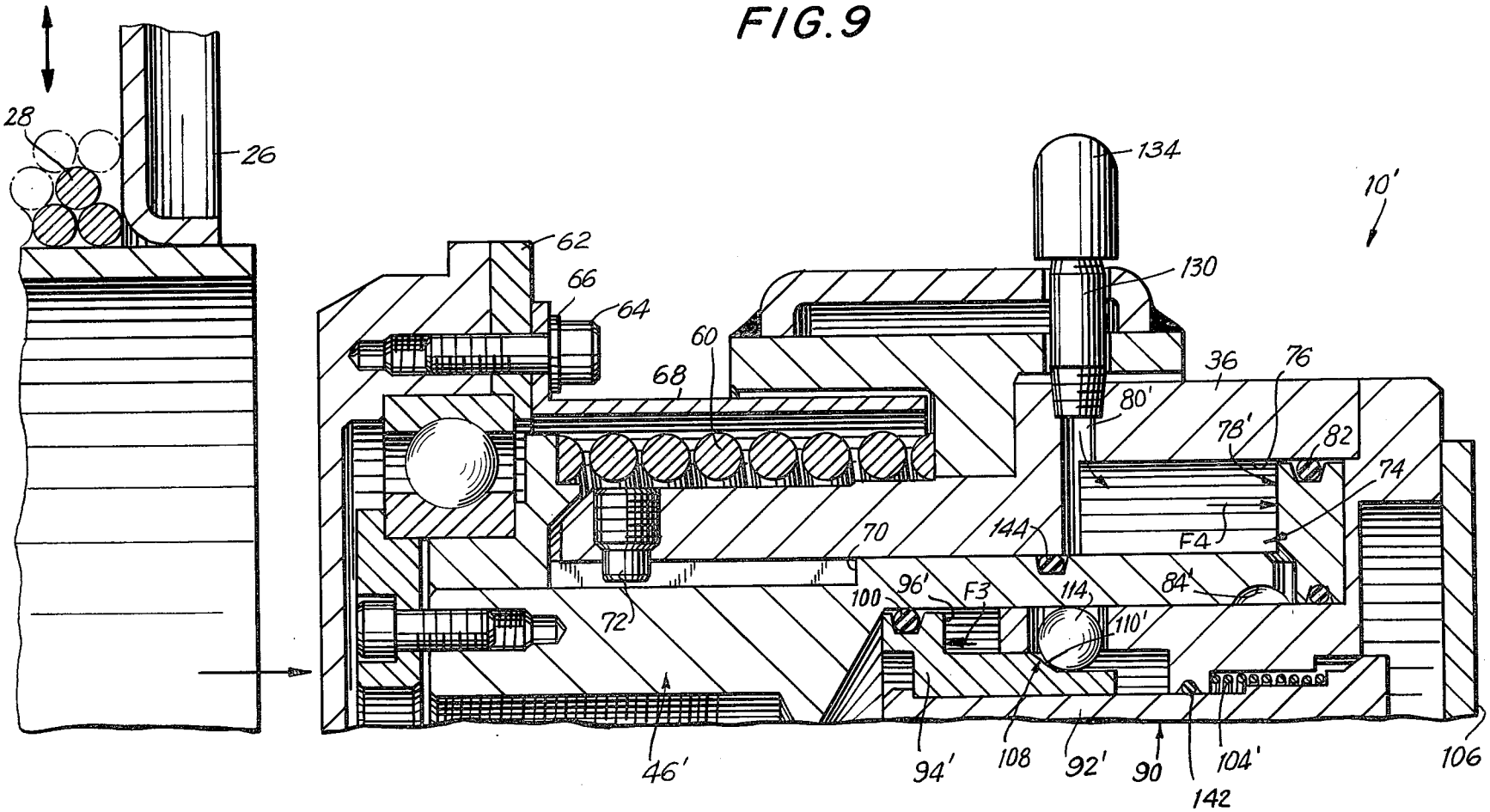
FIG. 9 is similar to FIG. 8, but showing the pintle assembly having moved from the extended position to a retracted position upon application of an externally applied pneumatic pressure.

In the embodiment 10 shown in FIGS. 1–7, the springs 60 and 104 are arranged to urge the primary locking element 46 and the safety plunger 90 in a common axial direction, the bearing surfaces 78 and 96 facing that same axial direction. In this manner, the application of a fluid medium under pressure causes the primary locking element 46 and the safety plunger 90 to be successively axially shifted or displaced against the actions of the two springs respectively. Referring to FIGS. 8 and 9, a second embodiment 10' of the pintle assembly is shown which need not rely on spring action alone or spring action in combination with ledges 118' to maintain the safety plunger 90 in its disabling position under the action of centrifugal forces. Here springs 60 and 104' are arranged to urge the primary locking element and the safety plunger 90' in opposing axial directions This is done to benefit from the effect of the centrifugal forces acting on the safety plunger to urge the same to its disabling position and thereby add another measure of safety to the locking device 10'. The bearing surface of each associated actuatable member faces the direction of action by the cooperating spring thereon. In FIG. 8, the primary locking element 46' is shown in its extended or retaining position due to the action of the compression spring 60, this position being towards the left as viewed in FIG. 8, similar to the corresponding position of the pintle assembly 10 shown in FIG. 4. However, now the spring 104' acts between an abutment or shoulder on the wall portion 42' and the safety plunger 90' to move the same to the disabling position which with the embodiment 10' is towards the right as viewed in FIG. 8, as compared with the corresponding position towards the left with the embodiment 10 shown in FIG. 4.

Upon application of a fluid medium under pressure into the conduit 80', forces F3 and F4 are simultaneously applied to the bearing surfaces 96' and 78' respectively. However, the primary locking element 46' cannot move in the direction of force F4 because it is positively locked by virtue of the engagement between the ball 114 and the abutment surface 84'. The only element which is free to move is the safety plunger 90' which moves towards the left, as viewed in FIG. 7, in response to the force F3

Referring to FIG. 9, once the safety plunger 90' has moved into the bore cavity 86 sufficiently so as to bring the step 108 or the inclined surface 110' sufficiently to the left so as to permit the ball 114 to move out of the path of movement of the primary locking element 46', the force F4 causes the primary locking element 46', together with the pintle 12 mounted thereon, to move towards the right to the position shown in FIG. 9. The movements of the safety plunger 90' from the disabling to the enabling positions, the ball 114 from the locking to the releasing positions, and the movement of the primary locking element 46 from the extended or retaining positions to the retracted or releasing positions are all automatically achieved upon application of a fluid medium under pressure to the conduit 80'. As soon as such pressure is removed, compression springs 60 and 104' automatically, and without any assistance from the operator, revert to their initial positions shown in FIG. 8 to positively lock the pintle 12 in the operative or retaining position.

In the embodiment 10' shown in FIGS. 8 and 9, the safety plunger is maintained in the disabling position by the action of the centrifugal forces acting thereon. The centrifugal forces in this embodiment urge the safety plunger in the same direction as does the spring 104', as opposed to the embodiment 10 where the centrifugal forces oppose the spring 104 and tend to move the safety plunger to the enabling position. Although this alternative embodiment shown in FIGS. 8 and 9 would, therefore, seem to provide superior safety, testing has shown that the pintle assembly 10 adequately and positively maintains the safety plunger 90 in the disabling position shown in FIG. 4 even at forces considerably greater than the ones that would be encountered in the worst accidental condition as discussed above. The pintle assembly 10 is somewhat preferred because of its simplicity of construction. As can be seen, the pintle assembly 10' uses a considerable number of additional O-rings 82', 142 and 144, and this increases the chances of malfunction and maintainance.

The two above-described embodiments of pintle assemblies 10 and 10' are only illustrative of the basic principle of the present invention. Numerous modifications of the described constructions may be made while still practicing the invention as defined in the appended claims. For example, while the bearing surfaces against which the fluid medium under pressure is applied have been shown as being disposed or provided on piston portions or on annular lips or wall portions of such pistons, the fluid medium can be applied to the slidably mounted postions or plungers in other conventional manners. Also, while the primary locking elements and the safety plungers have been shown to be telescopically arranged in the presently preferred embodiments so that application of fluid medium under pressure changes the overall effective lengths of the actuatable members, this is not, in and of itself, a critical feature of the present invention and any other arrangement of the slidably mounted pistons or plungers which achieves the functions above described can be used.

The present invention contemplates other modified constructions which automatically, by action of hydraulic or pneumatic pressure, provide positive locking action, this irrespective of the specific mechanical constructions which have been described above. It is easy to see, for example, that the system could be reversed using compressed air to close the pintle assembly to move the primary locking element to the extended position, while utilizing the action of the compression springs to open it or move the primary locking element to the retracted or releasing position. However, in such a case, the locking system would be continuously under stress since it would have to counteract the force of the spring which tends to open the spindle. In this situation, a failure of the locking system would cause an accident while in the above described arrangements it would not.

While the fail-safe locking device for reel carrying systems has primarily been described above in connection with pintle assemblies of the type commonly used on cradles in tubulartype stranders, it should be evident from the above description that the fail-safe locking devices may be utilized in other reel carrying systems whenever a reel or bobbin is to be securely and releasably and positively locked in place. More specifically, the reel engaging means cooperating with the primary locking element 46 in the embodiments shown in FIGS. 1–9 is in the nature of a pintle mounted on the shaft portion 48 of the primary locking element 46. However, numerous other applications exist where engaging means other than pintles may be mounted on and cooperate with the shaft portions 48 of the locking device 10.

To illustrate some other examples or possible applications of the fail-safe locking device in accordance with the present invention, reference is made to FIGS. 10 and 11. Here, a rigid-type strander 146 is shown to comprise a frame generally in the nature of a hollow body 148. A support member in the nature of a shaft 150 is shown fixedly or rigidly mounted on the frame 148, the shaft 150 having an axis substantially normal to the axis of rotation of the hollow body 148. Such an arrangement may be utilized to pay off wire from the bobbin as a result of centrifugal forces acting on the wire as the bobbin or reel 152 rotates about the axis of the hollow body 148. The bobbin or reel 152 has a bore **152*a* dimensioned to receive the shaft 150 as shown in FIG. 11. The bobbin or reel 152 has upper and lower flanges or circular members 152*b*, 152*c*** which define the annular space in which the wire on the bobbin is wound.

In stranders of this type, wherein rotation of a shaft or hollow body has the tendency to eject the bobbins or reels, it is imperative that suitable locking means be provided. As best shown in FIG. 11, the fail-safe locking device **10*a* is shown incorporated within the shaft 150 and fixedly secured thereto in any suitable or conventional manner. The shaft portion 48*a* of the actuatable member or primary locking element 46 is shown to be provided with a conical or tapered outer surface, tapering inwardly in the direction of the reel or bobbin engaging means. Here, in place of a pintle 12 mounted on the shaft portion, the reel or bobbin engaging means includes a plurality of fingers 154 spaced from each other about the axis of the shaft 150 and mounted for slidable movement in the radial direction on the shaft 150. Suitable compression springs 156 are provided which urge the fingers 154 radially inwardly or into the confines of the shaft 150. The springs 156 have the tendency of moving the fingers 154** to their reel or bobbin disengaging position, which position the fingers 154 move to when the shaft portion 48*a* is in the retracted position as suggested by the dashed outline in FIG. 11. As noted above. the primary locking element is normally locked in the extended position thereof shown in FIG. 11. As should be evident, when the shaft portion 48*a* moves to its locked, extended position shown in FIG. 11, the fingers 154 ride on the tapered external surface of the shaft portion as shown, thereby, a thrust outwardly to the locking or engaging positions shown. The shaft portion 48*a* forces the fingers 154 radially outwardly against the actions of the springs 156 to the engaging or locking positions thereof, the fingers engage the bobbin or reel 152 at the upper flange or circular member 152*b*. Since the shaft 150 is rigidly or fixedly connected to the rotating frame or hollow body 148, the fingers 154 likewise maintain the bobbin or reel 152 shaft 150 during rotation thereof. From the above-described embodiments, application of a pneumatic or hydraulic pressure in the line 158 causes the shaft portion 48*a* to move to a retracted, releasing position (as shown in dashed outline in FIG. 11) to thereby permit the fingers 154 to move radially inwardly by the action of the springs 156 and the bobbin or reel 152 may be released.

Referring to FIGS. 12 and 13, there is shown a still further embodiment of reel engaging means which avoids the need to maintain the springs 156′ in a state of compression during the locked condition of the bobbin, as is the case with the embodiment shown in FIGS. 10 and 11. In FIGS. 12 and 13, the shaft portion 48*b* is normally locked in the retracted, as opposed to the extended position as shown in FIG. 11. With the shaft portion 48*b* normally being in the retracted position as shown in FIG. 12, the shaft portion 48*b* may be provided with a tapered or conical surface which tapers in an opposite direction as the taper of the shaft portion 48*a*. With the embodiment shown in FIGS. 12 and 13, the locking device 10*b* must be slightly modified, as should be evident to those skilled in the art, to cause the shaft portion 48*b* to be in the locked position of the shaft portion when it is in a retracted position, shown in FIG. 12. Here, the fingers 160 have a generally sloping surface as shown riding upon the conical or inclined surface of the shaft portion 48*b*. When the shaft portion 48*b* is in the retracted position, the compression springs 156′ urge the fingers 160 to move to their extended or locked positions. It will, therefore, be evident that with the shaft portion 48*b* locked in the retracted position and by utilizing the tapered surface of the shaft portion 48*b*, the fingers 160 may be maintained in their extended locking positions without placing the springs 156′ in a state of compression.

When the shaft portion 48*b* is moved to its extended position, as shown in FIG. 13, the fingers 160 are caused to ride upon the inclined surface of the shaft portion, and are moved radially inwardly to the releasing positions thereof.

In FIGS. 14 and 15, the design of the shaft portion of 48*c*, as well as the fingers or bobbin engaging means 160′ is so selected so that the fingers 160′ are in the their extended, locking positions when the primary locking element or actuatable member is locked in the extended position as is the case in FIG. 11. However, in this embodiment, the springs 156 are not placed in a state of compression in the normal, locking positions of the fingers 160′. The arrangements shown in FIGS. 10, 11, 14 and 15 utilize the fail-safe locking devices as described above wherein the primary locking members or elements are locked in the extended positions thereof. In connection with the embodiment or arrangement shown in FIGS. 12 and 13, the locking device must be modified as suggested above to lock the primary locking element or shaft portion 10*b* in the retracted position thereof.

In the description of bobbin supporting shafts incorporating the fail-safe device of the present invention, the shafts have all been shown (FIGS. 10–15) as being normal to the axis of rotation of the tubular frame 148. However, this description was only by way of illustration, and clearly, the fail-safe locking device can be used on any cantilevered shafts of a reel supporting system. This includes reel supporting shafts normal, parallel or at any intermediate angular inclination relative to the axis of rotation of the machine. The same is true of the reel engaging means which are shown in FIGS. 10–15 and described above. It will become evident to any artisan skilled in the art that the basic fail-safe locking device may be made to cooperate with numerous types of reel engaging means, pintles and the finger or prong arangements shown being only illustrative.

It is to be understood, therefore, that the foregoing description of the various embodiments illustrated herein is exemplary only, and various modifications to the embodiments shown herein may be made without departing from the spirit and scope of the invention.

What is claimed is:

1. A fail-safe locking device for reel carrying systems, said device being mounted on a support member and comprising a first actuatable member mounted for slidable movement relative to the support member along an axis between first and second positions; reel engaging means cooperating with said first actuatable member for securely engaging a reel on the carrying system in said first position of said first actuatable member and for releasing the reel in said second position of said first actuatable member; first biasing means for urging said first actuatable member to said first position; locking means cooperating with said first actuatable member and the support member and movable between locking and releasing positions for permitting movement of said first actuatable member from said first to said second positions only in the releasing position thereof; a second actuatable member mounted for slidable movement relative to the support member between enabling and disabling positions for moving said locking means from said locking to said releasing position only in the enabling position thereof; second biasing means for urging said second actuatable member to said disabling position, said first and second actuatable means being provided with pressure bearing surfaces; and hydraulic means adapted to apply a fluid medium under pressure to said bearing surfaces for moving said second actuatable member to said enabling position only upon application of said fluid medium under pressure to thereby permit movement of said locking means to said releasing position, and for subsequent movement of said first actuatable member to said second position.

2. A locking device as defined in claim 1, wherein said first actuatable member comprises a piston shaft portion at one free end of which is mounted said reel engaging means and the opposing end of which is provided with an annular lip or wall portion which defines the bearing surface of said first actuatable member.

3. A locking device as defined in claim 2, wherein said shaft portion of said first actuatable member is provided with an axial bore at said opposing end, and said second actuatable member comprises a safety plunger having at least a portion thereof defining a bearing surface received within said axial bore said hydraulic means being adapted to simultaneously apply the fluid medium under pressure to said bearing surfaces of said first and second actuatable members.

4. A locking device as defined in claim 3, wherein said first and second biasing means are arranged to urge said first and second actuatable members in a common axial direction, and wherein said bearing surfaces of said first and second actuatable members face said axial direction, whereby application of said fluid medium under pressure by said hydraulic means causes said second and first actuatable members to be successively axially shifted or displaced against the actions of said second and first biasing means respectively.

5. A locking device as defined in claim 3, wherein said first and second biasing means are arranged to urge said first and second actuatable members in opposing axial directions, and wherein each bearing surface of an associated actuatable member faces the direction of biasing by the cooperating biasing means thereon.

6. A locking device as defined in claim 1, wherein said second actuatable member comprises a safety plunger having a shaft portion cooperating with said second biasing means, and an annular lip or wall portion at one end of said shaft portion which defines the bearing surface of said second actuatable member.

7. A locking device as defined in claim 1, wherein at least one of said actuatable members is provided with an axial bore, and wherein the other of said actuatable members is at least partially received within said bore, said actuatable members being coaxially and telescopically arranged to permit changes in the overall or effective length of said actuatable members upon actuation of said hydraulic means.

8. A locking device as defined in claim 1, wherein said first biasing means comprises a helical compression spring acting between said first actuatable member and the support member.

9. A locking device as defined in claim 1, wherein said second biasing means comprises a helical compression spring acting between said second actuatable member and the support member.

10. A locking device as defined in claim 1, wherein said bearing surfaces are disposed within cavities defined by cylindrical walls, and further comprising sealing means provided between the peripheries of said bearing surfaces and said cylindrical walls.

11. A locking device as defined in claim 10, wherein said sealing means comprises O-rings.

12. A locking device as defined in claim 1, further comprising stop means for limiting the rotational movement of said first actuatable member relative to the support member.

13. A locking device as defined in claim 12, wherein said stop means comprises a longitudinal groove on said first actuatable member and means on the support member projecting into and adapted to ride in said groove.

14. A locking device as defined in claim 1, further comprising stop means for limiting the movement of said second actuatable member relative to the support member and preventing said second biasing means from moving said second actuatable member beyond said disabling position.

15. A locking device as defined in claim 14, wherein said stop means comprises an abutment surface on said second actuatable member adapted to abut against a portion of the support member.

16. A locking device as defined in claim 1, wherein said first actuatable member has an abutment surface, said locking means comprising a blocking member mounted for radial movement between a radially outward locking position wherein said blocking member is at least partially positioned in the path of movement of said abutment surface to block movement of said first actuatable member from said first to said second position and radially inward releasing position wherein said blocking member is removed from the path of movement of said abutment surface, said second actuatable member being in the nature of a safety plunger and provided with a radially stepped exterior surface to provide a step or recess which maintains said blocking member in said radially outward locking position in the disabling position of said safety plunger and permits said blocking member to move radially inwardly into said recess to the releasing position upon movement of said safety plunger to said enabling position.

17. A locking device as defined in claim 16, wherein said abutment surface and blocking member are arranged to abut against each other in said extended position of said first actuatable member and in said disabling position of said safety plunger.

18. A locking device as defined in claim 16, wherein said blocking member is captured to prevent axial movements thereof relative to the support member.

19. A locking device as defined in claim 16, wherein said blocking member comprises a sphere or ball.

20. A locking device as defined in claim 16, wherein said blocking member comprises a cylinder or pin.

21. A locking device as defined in claim 16, further comprising a wall portion connected to said support member and disposed between said abutment surface of said first actuatable member and said stepped exterior surface of said second actuatable member, said wall portion being provided with an opening therethrough which at least partially receives said blocking member.

22. A locking device as defined in claim 21, wherein the radial dimension of said blocking member is greater than the radial thickness of said wall portion whereby said blocking member either projects radially beyond said wall portion into abutment against said abutment surface or radially inwardly into said recess.

23. A locking device as defined in claim 16, wherein a plurality of blocking members are provided and angularly spaced from each other about said axis.

24. A locking device as defined in claim 23, wherein said blocking members are uniformly angularly spaced about said axis.

25. A locking device as defined in claim 1, further comprising limit switch means for monitoring the position of said second actuatable member relative to the support member and becoming actuated upon movement of said second actuatable member from said disabling position.

26. A locking device as defined in claim 1, wherein said hydraulic means comprises pneumatic means adapted to apply air under pressure to said bearing surfaces.

27. A locking device as defined in claim 1, in combination with the support member which is in the nature of a cradle frame.

28. A locking device as defined in claim 27, wherein two pintle assemblies each including a fail-safe locking system are provided at opposing sides of said cradle frame and adapted to releasably support a reel.

29. A locking device as defined in claim 1, wherein said first actuatable member is in an extended position in said first position and in a retracted position in said second position.

30. A locking device as defined in claim 1, wherein said reel engaging means comprises a pintle adapted to be received within a bore of a bobbin or reel.

31. A locking device as defined in claim 1, wherein said reel engaging means comprises a plurality of radially movable fingers which move between radially inward bobbin releasing positions and radially outward bobbin retaining positions.

32. A fail-safe locking device for reel carrying systems, said device mounted on a support member and comprising a first actuatable member mounted for slidable movement relative to the support member along an axis between first and second positions; engaging means cooperating with said first actuatable member for securely engaging a reel on the reel carrying system in said first position of said first actuatable member and for releasing the reel in said second position of said first actuatable member; first biasing means for urging said first actuatable member to said second position; locking means cooperating with said first actuatable member and the support member and movable between locking and releasing positions for permitting movement of said first actuatable member from said second to said first positions only in the releasing position thereof; a second actuatable member mounted for slidable movement relative to the support member between enabling and disabling positions for moving said locking means from said locking to said releasing position only in the enabling position thereof; second biasing means for urging said second actuatable member to said disabling position, said first and second actuatable means being provided with bearing surfaces; and hydraulic means adapted to apply a fluid medium under pressure to said bearing surfaces for moving said second actuatable member to said enabling position only upon application of said fluid medium under pressure to thereby permit movement of said locking means to said releasing position, and for subsequent movement of said first actuatable member to said first position.

* * * * *